US010509339B2

(12) United States Patent
Furukawa et al.

(10) Patent No.: US 10,509,339 B2
(45) Date of Patent: Dec. 17, 2019

(54) IMAGE FORMING APPARATUS AND IMAGE FORMING METHOD

(71) Applicant: Oki Data Corporation, Tokyo (JP)

(72) Inventors: Yuichi Furukawa, Tokyo (JP); Kohei Kigawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/983,606

(22) Filed: May 18, 2018

(65) Prior Publication Data

US 2018/0348660 A1 Dec. 6, 2018

(30) Foreign Application Priority Data

May 31, 2017 (JP) ..... 2017-107716

(51) Int. Cl.

| | |
|---|---|
| ***G03G 15/01*** | (2006.01) |
| ***B41M 5/025*** | (2006.01) |
| ***G03G 15/00*** | (2006.01) |
| ***D06P 5/24*** | (2006.01) |
| ***G03G 15/20*** | (2006.01) |

(52) U.S. Cl.

CPC ..... *G03G 15/0131* (2013.01); *B41M 5/0256* (2013.01); *D06P 5/003* (2013.01); *G03G 15/2028* (2013.01); *G03G 15/50* (2013.01); *G03G 15/6591* (2013.01); *G03G 2215/00451* (2013.01); *G03G 2215/00523* (2013.01); *G03G 2215/2074* (2013.01)

(58) Field of Classification Search

CPC ..... G03G 15/0131; G03G 2215/00523; G03G 2215/00527; G03G 2215/00451; G03G 2215/2074

See application file for complete search history.

(56) References Cited

U.S. PATENT DOCUMENTS

| | | | |
|---|---|---|---|
| 7,081,324 | B1 | 7/2006 | Hare et al. |
| 9,500,976 | B1 | 11/2016 | Kobayashi et al. |
| 2004/0130745 | A1 | 7/2004 | Fabel et al. |
| 2015/0185678 | A1* | 7/2015 | Yoshida ..... G03G 15/6585 399/67 |

FOREIGN PATENT DOCUMENTS

| | | |
|---|---|---|
| JP | 2011152662 A | 8/2011 |

* cited by examiner

*Primary Examiner* — Ryan D Walsh
(74) *Attorney, Agent, or Firm* — Panitch Schwarze Belisario & Nadel LLP

(57) ABSTRACT

An image forming apparatus includes an image forming section and a controller. The image forming section selectively forms a first toner image to be printed on transfer paper other than plain paper with use of a toner and forms a second toner image to be printed on the plain paper with use of the toner. The controller controls the image forming section and thereby makes a first area density of the toner in the first toner image and a second area density of the toner in the second toner image differ from each other.

18 Claims, 6 Drawing Sheets

IMAGE FORMING APPARATUS AND IMAGE FORMING METHOD

CROSS REFERENCE TO RELATED APPLICATIONS

The present application claims priority from Japanese Patent Application No. 2017-107716 filed on May 31, 2017, the entire contents of which are hereby incorporated by reference.

BACKGROUND

The technology relates to an image forming apparatus and an image forming method.

A transfer sheet of a double-print scheme has been proposed, as disclosed in Japanese Unexamined Patent Application Publication No. 2011-152662, for example.

SUMMARY

When iron-on transfer printing is to be performed on fabrics such as a clothing fabric with the use of a transfer sheet of a double-print scheme, it is desired that a clearer image be formed.

It is desirable to provide an image forming apparatus and an image forming method that are suitable for achieving a higher-quality transfer printing image.

According to one embodiment of the technology, there is provided an image forming apparatus that includes an image forming section and a controller. The image forming section selectively forms a first toner image to be printed on transfer paper other than plain paper with use of a toner and forms a second toner image to be printed on the plain paper with use of the toner. The controller controls the image forming section and thereby makes a first area density of the toner in the first toner image and a second area density of the toner in the second toner image differ from each other.

According to one embodiment of the technology, there is provided an image forming method including: forming, with an image forming section, a first toner image and thereby allowing a toner to be attached to transfer paper other than plain paper at a first area density; and forming, with the image forming section, a second toner image and thereby allowing the toner to be attached to the plain paper at a second area density.

According to one embodiment of the technology, there is provided an image forming apparatus that includes an image forming section and a controller. The image forming section forms a toner image on a print medium with use of a toner. The controller controls the image forming section and thereby varies an area density of the toner to be attached to the print medium in accordance with a material of the print medium.

According to one embodiment of the technology, there is provided an image forming method including: determining a material of a print medium; and setting an area density of a toner to be attached to the print medium in accordance with the material of the print medium and forming a toner image on the print medium with use of the toner.

DETAILED DESCRIPTION

Some example embodiments of the technology will be described below in detail with reference to the drawings. It is to be noted that the following descriptions provide some specific but non-limiting examples of the technology, and the technology is not to be limited to the following example embodiments. In addition, the technology is not limited either in terms of the arrangement, the dimensions, and the ratios of the dimensions of the constituent elements illustrated in each drawing. The technology will be described in the following order.

1. Example Embodiments (Image Forming Apparatus of Basic Structure and Image Forming Method Using the Image Forming Apparatus)
2. Examples
3. Modification Examples

1. Example Embodiments

[1-1 Schematic Configuration of Image Forming Apparatus 1]

Figure 1A:
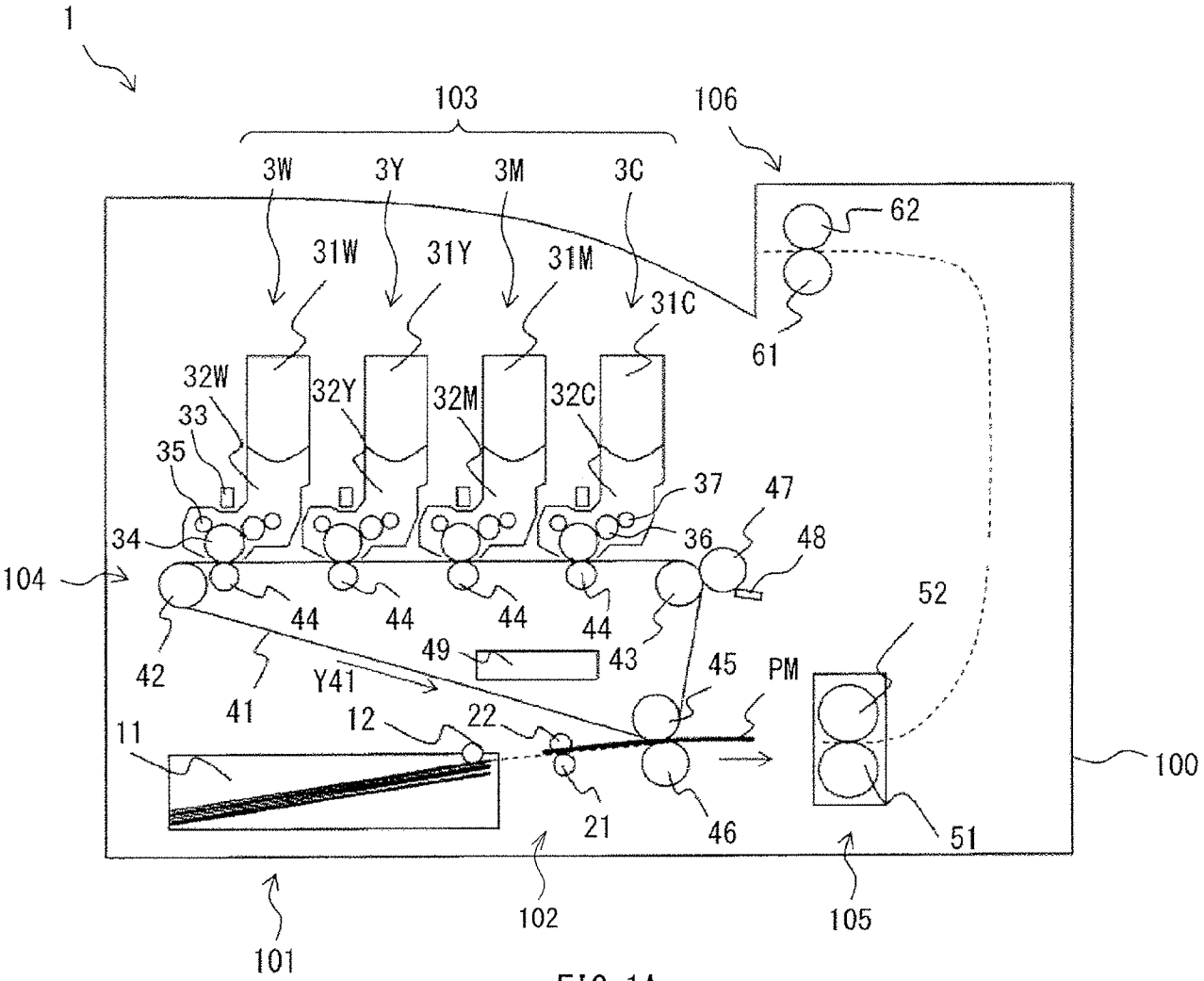
FIG. 1A is a schematic diagram illustrating an example of a general configuration of an image forming apparatus according to an example embodiment of the technology.
Figure 1B:
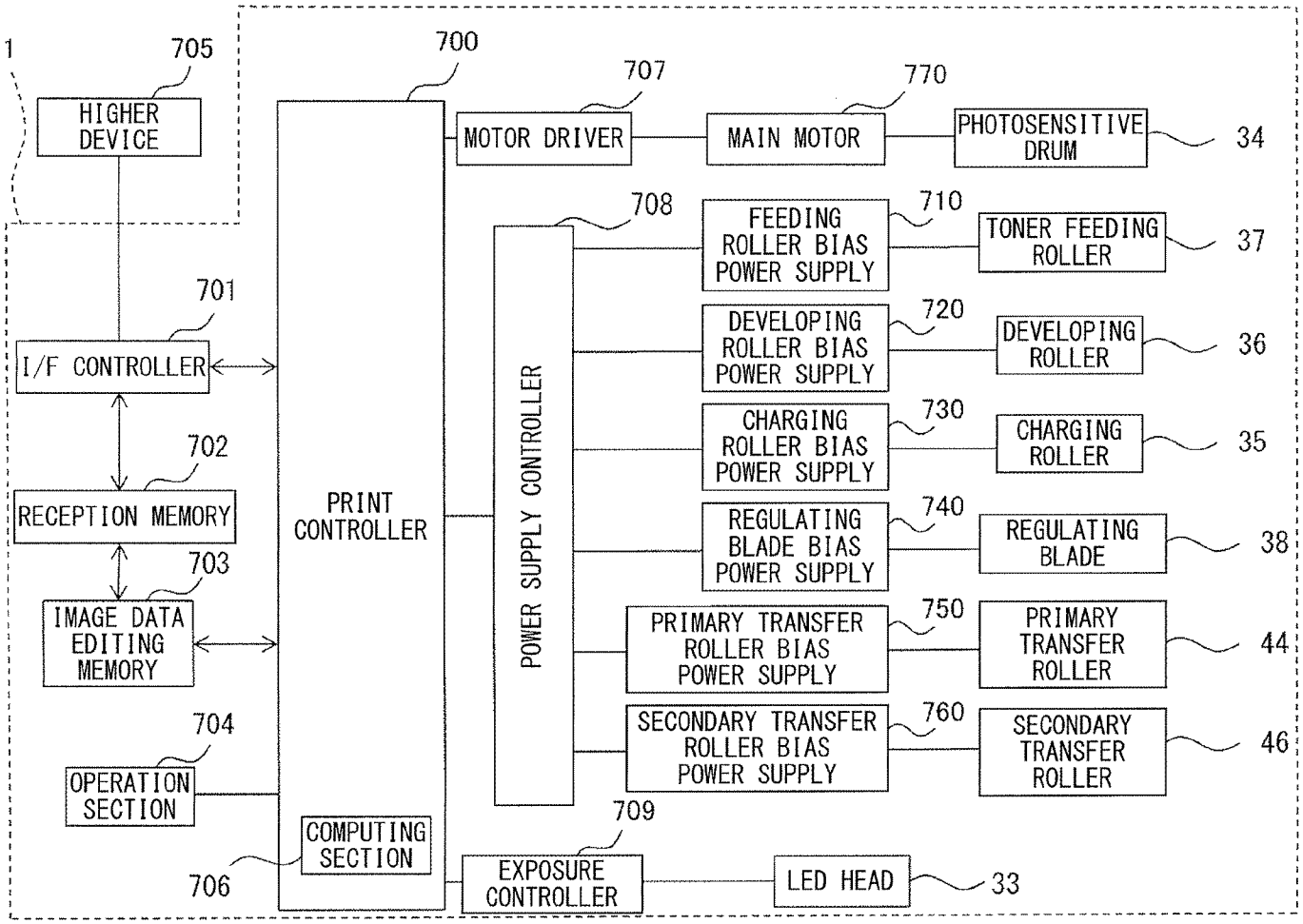
FIG. 1B is a block diagram schematically illustrating an example of an internal configuration of the image forming apparatus illustrated in FIG. 1A.

FIG. 1A is a schematic diagram illustrating an example of a general configuration of an image forming apparatus 1 according to an example embodiment of the technology. FIG. 1B is a block diagram corresponding to an internal configuration of the image forming apparatus 1 illustrated in FIG. 1A. The image forming apparatus 1 may be a printer of an electrophotographic scheme that, for example, forms an image, e.g., a color image, on various print media PM such as plain paper and an iron-on transfer printing sheet. In the following descriptions, a direction orthogonal to a conveyance direction of the print medium PM, i.e., an X-axis direction orthogonal to the paper plane in FIG. 1A, is referred to as a widthwise direction. In addition, in a conveyance route of the print medium PM, a direction toward a print medium cassette 11, described later, from a given position or a position closer to the print medium cassette 11 than a given position is referred to as upstream, and a direction away from the print medium cassette 11 from a given position or a position opposite to the print medium cassette 11 across a given position is referred to as downstream.

The image forming apparatus 1 may include a print medium feeding section 101, a print medium conveying section 102, an image forming section 103, a transfer section 104, a fixing device 105, and a discharge section 106, for example, and these components may be disposed in this order from the upstream inside a housing 100, for example.

[Print Medium Feeding Section 101]

The print medium feeding section 101 may include the print medium cassette 11, i.e., a print medium feeding tray, and a print medium feeding roller 12, for example. The print medium cassette 11 may contain a stack of a plurality of print media PM. The print medium feeding roller 12 may be a member that picks up the print medium PM one by one from the print medium cassette 11 and feeds the print medium PM to the print medium conveying section 102.

[Print Medium Conveying Section 102]

The print medium conveying section 102 may include a pair of conveying rollers 21 and 22, for example, and the conveying rollers 21 and 22 may be disposed to oppose each other. The pair of conveying rollers 21 and 22 may convey the print medium PM fed by the print medium feeding roller 12 to the image forming section 103 on the downstream. The print medium conveying section 102 may further include a position sensor disposed in the conveyance route to detect the position of the print medium PM.

[Image Forming Section 103]

The image forming section 103 may form a toner image, i.e., a developer image. The image forming section 103 may include four image forming units 3C, 3M, 3Y, and 3W, for example. The image forming units 3C, 3M, 3Y, and 3W may include toner cartridges 31C, 31M, 31Y, and 31W, respectively, and developing devices 32C, 32M, 32Y, and 32W, respectively.

The toner cartridges 31C, 31M, 31Y, and 31W may be containers that contain toners of respective colors thereinside. The toner cartridges 31C, 31M, 31Y, and 31W may each have a toner discharge opening provided in a lower portion thereof, and this configuration may allow the toners of the respective colors to be fed to the developing devices 32C, 32M, 32Y, and 32W. The toner cartridge 31C may contain a cyan toner, the toner cartridge 31M may contain a magenta toner, the toner cartridge 31Y may contain a yellow toner, and the toner cartridge 31W may contain a white toner. The toners will be described later in detail.

The developing devices 32C, 32M, 32Y, and 32W may include, for example: respective LED (Light Emitting Diode) heads 33, i.e., LED heads 33C, 33M, 33Y, and 33W; respective photosensitive drums 34, i.e., photosensitive drums 34C, 34M, 34Y, and 34W; respective charging rollers 35, i.e., charging rollers 35C, 35M, 35Y, and 35W; respective developing rollers 36, i.e., developing rollers 36C, 36M, 36Y, and 36W; respective toner feeding rollers 37, i.e., toner feeding rollers 37C, 37M, 37Y, and 37W; and respective regulating blades 38, i.e., regulating blades 38C, 38M, 38Y, and 38W. The regulating blades 38 are illustrated only in FIG. 1B. In FIG. 1A, the reference characters 33C, 33M, 33Y, and 33W are indicated as the LED heads 33 in the respective developing devices 32C, 32M, 32Y, and 32W. In a similar manner, the reference characters 34C, 34M, 34Y, and 34W are indicated as the photosensitive drums 34 in the respective developing devices 32C, 32M, 32Y, and 32W; the reference characters 35C, 35M, 35Y, and 35W are indicated as the charging rollers 35 in the respective developing devices 32C, 32M, 32Y, and 32W; the reference characters 36C, 36M, 36Y, and 36W are indicated as the developing rollers 36 in the respective developing devices 32C, 32M, 32Y, and 32W; the reference characters 37C, 37M, 37Y, and 37W are indicated as the toner feeding rollers 37 in the respective developing devices 32C, 32M, 32Y, and 32W; and the reference characters 38C, 38M, 38Y, and 38W are indicated as the regulating blades 38 in the respective developing devices 32C, 32M, 32Y, and 32W.

The LED heads 33C, 33M, 33Y, and 33W may perform exposure of surfaces of the photosensitive drums 34C, 34M, 34Y, and 34W that oppose the LED heads 33C, 33M, 33Y, and 33W, respectively, to form electrostatic latent images on the surfaces of the photosensitive drums 34C, 34M, 34Y, and 34W, respectively.

The photosensitive drums 34C, 34M, 34Y, and 34W may each be a substantially-columnar member that supports an electrostatic latent image on its surface, i.e., on its surface layer portion. The photosensitive drums 34C, 34M, 34Y, and 34W may each include a photoreceptor, e.g., an organic photoreceptor.

The charging rollers 35C, 35M, 35Y, and 35W may be substantially-columnar members, i.e., charging members, that charge the surfaces, i.e., the surface layer portions, of the photosensitive drums 34C, 34M, 34Y, and 34W, respectively. The charging rollers 35C, 35M, 35Y, and 35W may be disposed to be in contact with the surfaces, i.e., peripheral surfaces, of the photosensitive drums 34C, 34M, 34Y, and 34W, respectively.

The developing rollers 36C, 36M, 36Y, and 36W may each be a substantially-columnar member that supports, on its surface, a toner directed to developing an electrostatic latent image. The developing rollers 36C, 36M, 36Y, and 36W may be disposed to be in contact with the surfaces, i.e., the peripheral surfaces, of the photosensitive drums 34C, 34M, 34Y, and 34W, respectively.

The toner feeding rollers 37C, 37M, 37Y, and 37W may be substantially-columnar members directed to feeding the toners to the developing rollers 36C, 36M, 36Y, and 36W, respectively. The toner feeding rollers 37C, 37M, 37Y, and 37W may be disposed to be in contact with the surfaces, i.e., peripheral surfaces, of the developing rollers 36C, 36M, 36Y, and 36W, respectively.

The regulating blades 38C, 38M, 38Y, and 38W may be members that regulate the amount of toners supported on the surfaces of the respective developing rollers 36C, 36M, 36Y, and 36W.

[Transfer Section 104]

The transfer section 104 may transfer a toner image formed in the image forming section 103 onto a print medium PM. The transfer section 104 may include an intermediate transfer belt 41, a driving roller 42, a driven roller 43, a plurality of primary transfer rollers 44, a backup roller 45, a secondary transfer roller 46, a conveying roller 47, a cleaning blade 48, and a waste toner box 49, for example.

The intermediate transfer belt 41 may be an elastic endless belt including a resin material such as polyimide resin, for example. The intermediate transfer belt 41 may be stretched upon, or looped around, the driving roller 42, the driven roller 43, and the backup roller 45 and may circularly rotate in a direction indicated by an arrow Y41 indicated in FIG. 1A.

The driving roller 42 may drive the intermediate transfer belt 41 with driving force provided from a main motor 770, described later, for example. The driven roller 43 may rotate in accordance with the rotation of the intermediate transfer belt 41 driven by the driving roller 42.

The plurality of primary transfer rollers 44, i.e., primary transfer rollers 44C, 44M, 44Y, and 44W, may be disposed at respective positions where the primary transfer rollers 44 oppose the respective photosensitive drums 34 with the intermediate transfer belt 41 interposed therebetween. The plurality of primary transfer rollers 44, i.e., the primary transfer rollers 44C, 44M, 44Y, and 44W, and their corresponding photosensitive drums 34, i.e., the photosensitive drums 34C, 34M, 34Y, and 34W, form respective primary transfer sections. The primary transfer rollers 44C, 44M, 44Y, and 44W may be members directed to electrostatically transferring, onto the intermediate transfer belt 41, the toner images formed in the respective image forming units 3C, 3M, 3Y, and 3W while conveying the print medium PM in the conveying direction. The primary transfer rollers 44C, 44M, 44Y, and 44W may be formed of an electrically-semiconductive foamed elastic rubber material, for example. A predetermined bias voltage, i.e., a primary transfer voltage, may be applied to each of the primary transfer rollers 44C, 44M, 44Y, and 44W by a primary transfer roller bias power supply 750, as illustrated in FIG. 1B. The bias voltage applied to each of the primary transfer rollers 44C, 44M, 44Y, and 44W may be controlled by a power supply controller 708, for example, as illustrated in FIG. 1B.

The backup roller 45 and the secondary transfer roller 46 may be disposed to oppose each other with the intermediate transfer belt 41 interposed therebetween. The backup roller 45 and the secondary transfer roller 46 may form a secondary transfer section. In the secondary transfer section, while the print medium PM held between the intermediate transfer belt 41 and the secondary transfer roller 46 is being conveyed in the conveyance direction, a toner image that has undergone a primary transfer onto the intermediate transfer belt 41 may electrostatically undergo a secondary transfer onto the aforementioned print medium PM. The secondary transfer roller 46 may include, for example, a metal core and an elastic layer, such as a foamed rubber layer, provided to be wrapped around an outer peripheral surface of the core. The secondary transfer roller 46 may be urged toward the backup roller 45. Thus, the secondary transfer roller 46 may be in a state of being pressed against the backup roller 45 with the intermediate transfer belt 41 interposed therebetween, and the print medium PM passing through the secondary transfer section may thus have a predetermined transfer pressure applied thereto. In addition, a predetermined bias voltage controlled by the power supply controller 708 may be applied to the secondary transfer roller 46 by a secondary transfer roller bias power supply 760, for example, as illustrated in FIG. 1B. Applying the bias voltage to the secondary transfer roller 46 may produce a potential difference between the backup roller 45 and the secondary transfer roller 46, which may thus cause the toner image to be transferred onto the print medium PM on the intermediate transfer belt 41.

The conveying roller 47 may be disposed to oppose the driven roller 43 with the intermediate transfer belt 41 interposed therebetween. The conveying roller 47 may be a member that assists in a rotation operation of the intermediate transfer belt 41. A waste toner that has remained on the intermediate transfer belt 41 without undergoing a secondary transfer onto the print medium PM in the secondary transfer section may be scraped off by the cleaning blade 48 via the conveying roller 47 and conveyed to the waste toner box 49 to be contained therein.

[Fixing Device 105]

The fixing device 105 may be a member that heats and applies pressure to the toner image transferred onto the print medium PM conveyed from the transfer section 104 and thus fixes the toner image onto the print medium PM. The fixing device 105 may include a heat roller 51 and a backup roller 52. The heat roller 51 may have, for example, a heater embedded therein, and the backup roller 52 may oppose the heat roller 51.

[Discharge Section 106]

The discharge section 106 may include a pair of discharge rollers 61 and 62 that are disposed to oppose each other. The discharge section 106 may further include a position sensor that detects the position of the print medium PM having been discharged from the fixing device 105 and traveling along the conveyance route. The discharge rollers 61 and 62 may discharge the print medium PM discharged from the fixing device 105 to the outside of the housing 100.

[1-2 Configuration of Control Mechanism of Image Forming Apparatus 1]

As illustrated in FIG. 1B, the image forming apparatus 1 may include a print controller 700, an interface (I/F) controller 701, a reception memory 702, an image data editing memory 703, and an operation section 704. The print controller 700 may have a computing section 706 embedded therein. The image forming apparatus 1 may further include a motor driver 707, the power supply controller 708, and an exposure controller 709 that each receive an instruction from the print controller 700. The image forming apparatus 1 may further include a feeding roller bias power supply 710, a developing roller bias power supply 720, a charging roller bias power supply 730, a regulating blade bias power supply 740, the primary transfer roller bias power supply 750, the secondary transfer roller bias power supply 760, and the main motor 770. The feeding roller bias power supply 710, the developing roller bias power supply 720, the charging roller bias power supply 730, the regulating blade bias power supply 740, the primary transfer roller bias power supply 750, and the secondary transfer roller bias power supply 760 may each be coupled to the power supply controller 708 and controlled by the power supply controller 708. The feeding roller bias power supply 710, the developing roller bias power supply 720, the charging roller bias power supply 730, the regulating blade bias power supply 740, the primary transfer roller bias power supply 750, and the secondary transfer roller bias power supply 760 may, respectively, be coupled to and apply voltages to the toner feeding rollers 37, the developing rollers 36, the charging rollers 35, the regulating blades 38, the primary transfer rollers 44, and the secondary transfer roller 46.

The print controller 700 may be constituted by components such as a microprocessor, a read-only memory (ROM), a random-access memory (RAM), or an input/output port. The print controller 700 may control an overall processing operation of the image forming apparatus 1 by executing a predetermined program, for example. In one example, the print controller 700 may receive print data and a control command from the I/F controller 701 and carry out a printing operation by integrally controlling the motor driver 707, the power supply controller 708, and the exposure controller 709.

The/F controller 701 may receive print data and a control command from a higher device 705 such as a personal computer (PC) or may transmit a signal concerning the status of the image forming apparatus 1.

The reception memory 702 may temporarily store the print data received from the higher device 705 via the I/F controller 701.

The image data editing memory 703 may receive the print data stored in the reception memory 702 and store image data resulting from editing the print data.

The operation section 704 may include an LED lamp and an input unit, e.g., a button or a touch pad, for example. The LED lamp may be directed to displaying information such as the status of the image forming apparatus 1. The input unit may be for a user to provide an instruction to the image forming apparatus 1.

The feeding roller bias power supply 710 may apply a predetermined bias voltage, i.e., a feeding voltage, to the toner feeding rollers 37 in accordance with an instruction of the power supply controller 708 that is under the control of the print controller 700, and this application of the bias voltage may cause the toners to be fed from the toner feeding rollers 37 to the developing rollers 36.

The developing roller bias power supply 720 may apply a predetermined bias voltage, i.e., a developing voltage, to the developing rollers 36 in accordance with an instruction of the power supply controller 708 that is under the control of the print controller 700, and this application of the bias voltage may cause the electrostatic latent images formed on the surfaces of the photosensitive drums 34 to be developed with the toners.

The charging roller bias power supply 730 may apply a predetermined bias voltage, i.e., a charging voltage, to the charging rollers 35 in accordance with an instruction of the power supply controller 708 that is under the control of the print controller 700, and this application of the bias voltage may cause the surfaces of the photosensitive drums 34 to become charged.

The primary transfer roller bias power supply 750 may apply a predetermined bias voltage, i.e., a primary transfer voltage, to the primary transfer rollers 44 in accordance with an instruction of the power supply controller 708 that is under the control of the print controller 700, and this application of the bias voltage may cause the toner images on the photosensitive drums 34 to undergo a primary transfer onto the intermediate transfer belt 41.

The secondary transfer roller bias power supply 760 may apply a predetermined bias voltage, i.e., a secondary transfer voltage, to the secondary transfer roller 46 in accordance with an instruction of the power supply controller 708 that is under the control of the print controller 700, and this application of the bias voltage may cause the toner image on the intermediate transfer belt 41 to undergo a secondary transfer onto the print medium PM.

The exposure controller 709 may control an exposure operation of the LED heads 33 in accordance with the image data stored in the image data editing memory 703.

The main motor 770 may be coupled to the motor driver 707. The main motor 770 may drive and rotate the photosensitive drums 34 in accordance with an instruction from the motor driver 707.

[1-3 Configuration of Toner]

In the image forming apparatus 1, a toner in which an external additive agent, i.e., an external additive, such as inorganic fine powder or organic fine powder, is added to a base particle containing a binder resin is used, for example.

In one example, non-limiting examples of the binder resin may include polyester-based resin, styrene-acrylic resin, epoxy-based resin, and styrene-butadiene-based resin. The binder resin may also be a mixture of a plurality of types of resin. Non-limiting examples of such a mixture may include a mixture obtained by mixing crystalline polyester resin into a plurality of amorphous polyester-based resins. The base particle may contain, in addition to a release agent and a colorant, a material such as an electric charge control agent, an electric conductivity modifier, a flow improver, or a cleaning improver, for example.

In one example, the base particle may be fabricated through pulverization. In pulverization, a block of toner base particles may be fabricated in advance by melting and blending resin such as the binder resin, the release agent, and the electric charge control agent with the use of a machine such as an extrusion molding machine or a dual-axis blender; upon being cooled, the block may be coarsely pulverized by a device such as a cutter mill; and the pulverized resultant may then be further pulverized by an impact pulverizer and classified by a classifier such as an air classifier. Through the classification, toner base particles having a predetermined particle size of about 6 μm to about 7 μm, for example, may be obtained.

Non-limiting examples of the release agent may include low-molecular-weight polyethylene, low-molecular-weight polypropylene, a copolymer of olefin, aliphatic-hydrocarbon-based wax, an oxide of aliphatic-hydrocarbon-based wax or a block copolymer thereof, waxes containing fatty acid ester as a primary component, partially-deoxidized or fully-deoxidized fatty acid esters. Non-limiting examples of the aliphatic-hydrocarbon-based wax may include microcrystalline wax, paraffin wax, and Fischer-Tropsch wax. Non-limiting examples of the oxide of the aliphatic-hydrocarbon-based wax may include oxidized polyethylene wax. Non-limiting examples of the waxes containing the fatty acid ester as a primary component may include carnauba wax and montanic acid ester wax. Non-limiting examples of the partially-deoxidized or fully-deoxidized fatty acid esters may include deoxidized carnauba wax. The release agent may be contained at a proportion of from about 0.1 parts by weight to about 20 parts by weight with respect to about 100 parts by weight of the binder resin. In one example, the release agent may be contained at a proportion of from about 0.5 parts by weight to about 12 parts by weight with respect to about 100 parts by weight of the binder resin. It is also possible to use a plurality of types of release agents in combination, and in one example, a plurality of types of release agents may be used in combination.

Non-limiting examples of the colorant may include titanium oxide, carbon black, iron oxide, Phthalocyanine Blue, Permanent Brown FG, Brilliant Fast Scarlet, Pigment Green B, Rhodamine-B base, Solvent Red 49, Solvent Red 146, Pigment Blue 15:3, Solvent Blue 35, quinacridone, Carmine 6B, and Disazo Yellow. These dyes and pigments may each be used alone, or a plurality of types of these dyes and pigments may be used in combination. In addition, a pigment used for a special purpose, such as a fluorescent pigment, a fluorescent brightener, or a magnetic pigment, may also be used. The colorant may be contained at a proportion of from about 2 parts by weight to about 25 parts by weight with respect to about 100 parts by weight of the binder resin. In one example, the colorant may be contained at a proportion of from about 2 parts by weight to about 15 parts by weight with respect to about 100 parts by weight of the binder resin.

Non-limiting examples of the electric charge control agent may include, in the case of a toner with negative chargeability, for example, an azo-based complex electric charge control agent, a salicylic-acid-based complex electric charge control agent, and a calixarene-based electric charge control agent. The electric charge control agent may be contained, for example, at a proportion of from about 0.05 parts by weight to about 15 parts by weight with respect to about 100 parts by weight of the binder resin. In one example, the electric charge control agent may be contained at a proportion of from about 0.1 parts by weight to about 10 parts by weight with respect to about 100 parts by weight of the binder resin.

A resultant fabricated by subjecting materials such as the binder resin, the release agent, the colorant, and the electric charge control agent described above to a process such as pulverization may serve as the toner base particle.

As the external additive to be added to the toner base particle, for example, hydrophobic silica R972, having a mean particle size of about 16 nm, available from NIPPON AEROSIL Co., Ltd., Tokyo, Japan, may be used in consideration of improving characteristics such as the environmental stability, the electric charge stability, the development performance, the flowability, or the storability. The external additive may be added, for example, at a proportion of from about 0.01 parts by weight to about 10 parts by weight with respect to about 100 parts by weight of the binder resin. In one example, the external additive may be added at a proportion of from about 0.05 parts by weight to about 8 parts by weight with respect to about 100 parts by weight of the binder resin. To adjust the characteristics such as the flowability of the toner, for example, about 0.5 parts by weight to about 3.0 parts by weight of silica having a particle size of greater than about 50 nm may be added as the external additive.

[1-4 Workings and Effects]

[A. Basic Operation of Image Forming Apparatus 1]

In the image forming apparatus 1, a toner image may be transferred onto a print medium PM in the following manner.

In one example, as illustrated in FIG. 1A, first, the print medium PM contained in the print medium cassette 11 may be picked up one by one from the uppermost portion by the print medium feeding roller 12 and let out toward the print medium conveying section 102 on the downstream. Thereafter, the print medium PM let out by the print medium feeding roller 12 may be conveyed to the secondary transfer section in the transfer section 104 on the downstream while having the oblique posture of the print medium PM, if any, being corrected by the print medium conveying section 102. The print medium PM may be conveyed, for example, with the use of the driving force of the main motor 770 in accordance with an instruction from the print controller 700. In the image forming section 103 and the transfer section 104, a toner image may be transferred onto the print medium PM in the following manner.

The print controller 700 of the image forming apparatus 1, which has been powered on, may receive print image data and a print command from the higher device 705 via the I/F controller 701. In response thereto, the print controller 700 may cooperate with components such as the motor driver 707 in accordance with the print command to start the printing operation of the print image data.

The motor driver 707 may drive the main motor 770 to rotate the photosensitive drums 34 in a predetermined direction at a constant speed. Upon the photosensitive drums 34 rotating, the motive power of the photosensitive drums 34 may be transmitted to each of the toner feeding rollers 37, the developing rollers 36, and the charging rollers 35 via a drive transmission section, such as a gear train. As a result, the toner feeding rollers 37, the developing rollers 36, and the charging rollers 35 may each rotate in a predetermined direction.

Meanwhile, the power supply controller 708 may control the charging roller bias power supply 730 in accordance with an instruction from the print controller 700 to apply a predetermined voltage to the charging rollers 35C, 35M, 35Y, and 35W and to uniformly charge each of the surfaces of the photosensitive drums 34C, 34M, 34Y, and 34W.

Thereafter, the exposure controller 709 may start the LED heads 33C, 33M, 33Y, and 33W to irradiate each of the photosensitive drums 34C, 34M, 34Y, and 34W with light corresponding to a print image that is based on an image signal, and this irradiation may cause an electrostatic latent image to be formed on each of the surfaces of the photosensitive drums 34C, 34M, 34Y, and 34W. Furthermore, the toners may be fed from the toner cartridges 31C, 31M, 31Y, and 31W to the toner feeding rollers 37C, 37M, 37Y, and 37W, respectively. The toners may be supported on the toner feeding rollers 37C, 37M, 37Y, and 37W and may move to the vicinity of the developing rollers 36C, 36M, 36Y, and 36W along with the rotations of the toner feeding rollers 37C, 37M, 37Y, and 37W. The toners may then be charged, for example, negatively as a result of a potential difference between the potentials of the developing rollers 36C, 36M, 36Y, and 36W and the potentials of the toner feeding rollers 37C, 37M, 37Y, and 37W, and the negatively-charged toners may be fed to the developing rollers 36C, 36M, 36Y, and 36W. The toners fed to the developing rollers 36C, 36M, 36Y, and 36W may form toner layers having a thickness regulated to a predetermined thickness by the regulating blades 38C, 38M, 38Y, and 38W.

Furthermore, the toner layers on the developing rollers 36C, 36M, 36Y, and 36W may be developed in accordance with the electrostatic latent images formed on the surfaces of the photosensitive drums 34C, 34M, 34Y, and 34W, and a toner image may be formed on each of the photosensitive drums 34C, 34M, 34Y, and 34W. These toner images may undergo a primary transfer while being successively superimposed on each other on the intermediate transfer belt 41 with the use of a potential difference between the photosensitive drums 34C, 34M, 34Y, and 34W and the primary transfer rollers 44C, 44M. 44Y, and 44W to which the predetermined bias voltages have been applied under the control of the power supply controller 708.

After the primary transfer, the toner image may undergo a secondary transfer onto the print medium PM conveyed to the secondary transfer section of the transfer section 104. In one example, the conveyance speed of the print medium PM and the linear speed of the surface of the intermediate transfer belt 41 may be adjusted, and the print medium PM and the toner image on the intermediate transfer belt 41 may be thereby registered with respect to each other. Thereafter, the toner image on the intermediate transfer belt 41 may undergo the secondary transfer onto the print medium PM with the use of a potential difference between the intermediate transfer belt 41 and the secondary transfer roller 46 to which the predetermined bias voltage has been applied under the control of the power supply controller 708.

Thereafter, in the fixing device 105, the toner image transferred to the print medium PM may be heated and applied with pressure to be fixed onto the print medium PM. The print medium PM on which the toner image has been fixed may thereafter be discharged to the outside by the discharge section 106.

[B. Details of Image Forming Method Performed by Image Forming Apparatus 1]

In the image forming apparatus 1, the print controller 700 may select, as appropriate, the area density of the toner in a toner image to be formed on a print medium PM in accordance with the type, e.g., the material, of the print medium PM, and the image forming section 103 may form a toner image having a predetermined area density under the control of the print controller 700. In one example, the image forming section 103 may selectively form a toner image to be printed on an iron-on transfer printing sheet or form a toner image to be printed on plain paper. Hereinafter, the toner image to be printed on an iron-on transfer printing sheet may be referred to as a first toner image, and the toner image to be printed on plain paper may be referred to as a second toner image. The iron-on transfer printing sheet may correspond to "transfer paper" according to one specific but non-limiting embodiment of the technology. In this example, the print controller 700 may control the image forming section 103 to make the area density of the toner in the first toner image and the area density of the toner in the second toner image differ from each other. Hereinafter, the area density of the toner in the first toner image may be referred to as a first area density, and the area density of the toner in the second toner image may be referred to as a second area density. The iron-on transfer printing sheet in this example may be a sheet that includes a substrate and an adhesive layer covering the substrate, and the first toner image may be formed to be printed on the adhesive layer. For example, a dark garment transfer paper WoW 7.8M sheet, available from TheMagic Touch (GB) Ltd., Dieburg, Germany, may be used as the iron-on transfer printing sheet, but the technology is not limited thereto. The print controller 700 may further control the image forming section 103 to select one of the first area density and the second area density in accordance with the color of the toner. In a case where the toners of a plurality of colors are to be superimposed on each other on a single print medium PM, the print controller 700 may control the image forming section 103 to select one of the first area density and the second area density in accordance with the color of the toner to be attached on the uppermost layer. In one example, the print controller 700 may control the image forming section 103 to make the first area density and the second area density differ from each other when the image forming section 103 performs printing at a maximum area density that is allowed to be set for each of the plurality of color toners. In another example, the print controller 700 may control the image forming section 103 to make the first area density and the second area density differ from each other when the image forming section 103 forms a solid pattern, described later, of each color with the use of each color toner.

In one example, in a case where the image forming section 103 uses a first color toner and a second color toner as the toners, for example, the print controller 700 may control the image forming section 103 to make the first area density of the first color toner and the second area density of the first color toner differ from each other and to make the first area density of the second color toner and the second area density of the second color toner substantially equal to each other. In this example, the first color toner may be a cyan toner, for example, and the second color toner may be a magenta toner, a yellow toner, and a white toner. Non-limiting examples of the cyan toner may include a cyan toner that contains Phthalocyanine Blue as a pigment, for example. The print controller 700 may control the image forming section 103 to make the first area density of the cyan toner in the first toner image to be formed on the iron-on transfer printing sheet lower than the second area density of the cyan toner in the second toner image to be formed on the plain paper, for example.

In one example, the first area density of the cyan toner in the first toner image to be formed on the iron-on transfer printing sheet may be, for example, equal to or greater than about 0.32 mg/cm$^2$ and equal to or less than about 0.45 mg/cm$^2$, and the second area density in the second toner image to be formed on the plain paper may be equal to or greater than about 0.45 mg/cm$^2$ and equal to or less than about 0.5 mg/cm$^2$.

Figure 2:
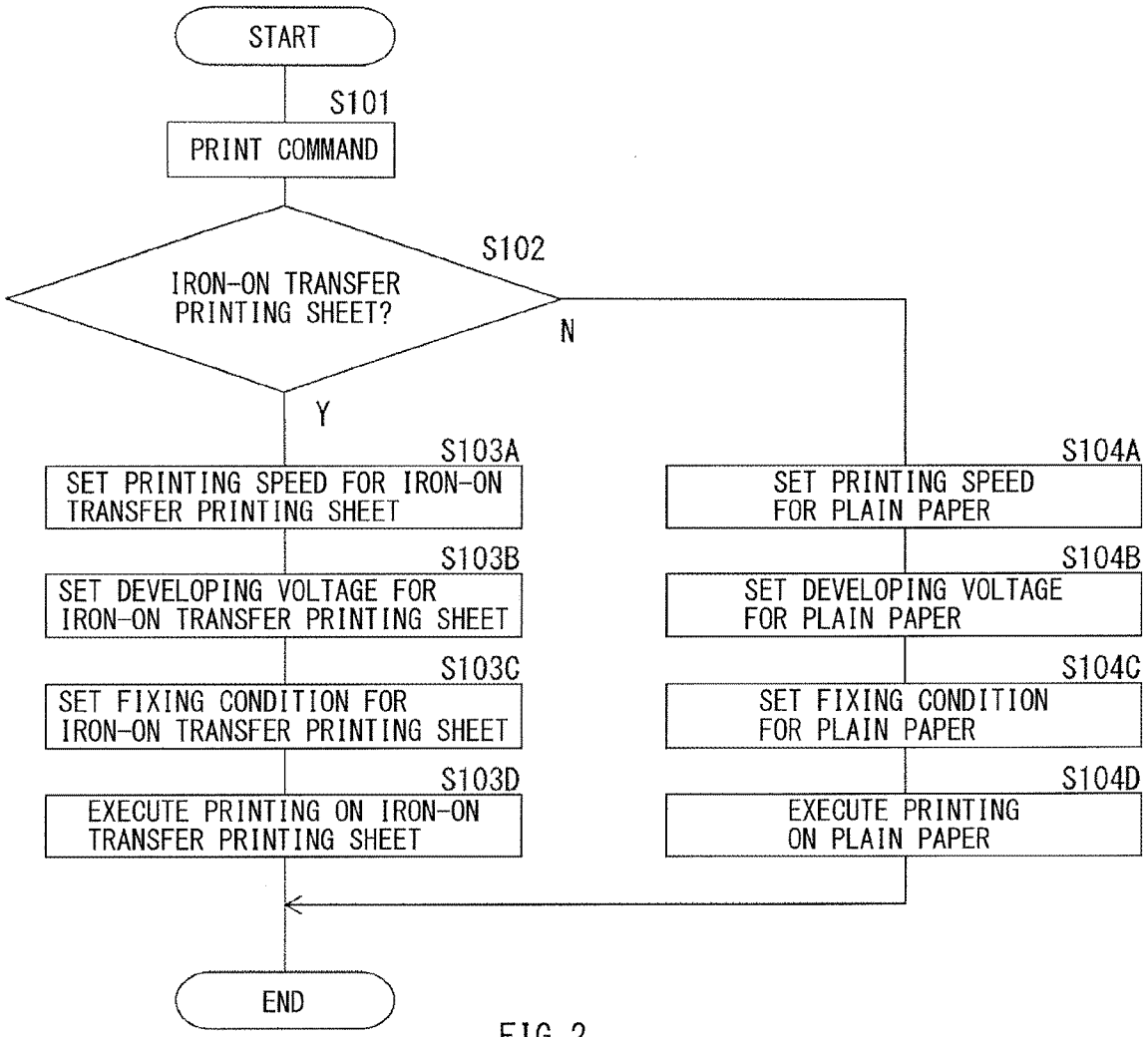
FIG. 2 is a flowchart illustrating an example of a printing flow of the image forming apparatus illustrated in FIG. 1A.

Referring to FIG. 2, the operation of the image forming apparatus 1 will be described in detail. FIG. 2 is a flowchart illustrating an example of a printing flow in the image forming apparatus 1. As described above, the print controller 700 of the image forming apparatus 1, which has been powered on, may receive print image data and a print command from the higher device 705 via the I/F controller 701 (step S101). Thereafter, the print controller 700 may determine the type of the print medium PM on the basis of information input by an operator through the operation section 704, for example. In other words, the print controller 700 may determine whether the print medium PM is an iron-on transfer printing sheet (step S102). If it is determined that the print medium PM is an iron-on transfer printing sheet (Y in step S102), the print controller 700 may select a special printing mode for the iron-on transfer printing sheet and cause the image forming section 103 to form a toner image at the second area density. In one example, a printing speed suitable for the iron-on transfer printing sheet may be set (step S103A), a developing voltage for each color suitable for the iron-on transfer printing sheet may be set (step S103B), fixing conditions such as a fixing speed suitable for the iron-on transfer printing sheet may be set (step S103C), and thereafter a printing operation onto the iron-on transfer printing sheet may be executed (step S103D). In contrast, if it is determined in step S102 that the print medium PM is not an iron-on transfer printing sheet (N in step S102), the print controller 700 may select a regular printing mode and cause the image forming section 103 to form a toner image at the first area density. In one example, a printing speed suitable for the plain paper may be set (step S104A), a developing voltage for each color suitable for the plain paper may be set (step S104B), fixing conditions such as a fixing speed suitable for the plain paper may be set (step S104C), and thereafter a printing operation onto the plain paper may be executed (step S104D).

The bias voltages, i.e., the developing voltages, applied to the respective developing rollers 36C, 36M, 36Y, and 36W when the first toner image to be printed on plain paper is formed are denoted by VN(C), VN(M), VN(Y), and VN(W), respectively. In addition, the bias voltages, i.e., the developing voltages, applied to the respective developing rollers 36C, 36M, 36Y, and 36W when the second toner image to be printed on an iron-on transfer printing sheet is formed are denoted by VT(C), VT(M), VT(Y), and VT(W), respectively. In this case, the power supply controller 708 may control the developing roller bias power supply 720 to satisfy the following conditional expressions (1) to (4).

$$|VN(C)|>|VT(C)| \quad (1)$$

$$|VN(M)|=|VT(M)| \quad (2)$$

$$|VN(Y)|=|VT(Y)| \quad (3)$$

$$|VN(W)|=|VT(W)| \quad (4)$$

With regard to the bias voltages, i.e., the developing voltages, applied to the developing rollers 36C, 36M, 36Y, and 36W, the greater the absolute values thereof, the greater the amount of toners that move onto the surfaces of the photosensitive drums 34C, 34M, 34Y, and 34W, which thus may lead to an increase in the area density of the toner image. Therefore, in a case where the cyan toner is used as the first color toner, satisfying the conditional expression (1) may make the first area density obtained when forming the first toner image to be printed on the iron-on transfer printing sheet lower than the second area density obtained when forming the second toner image to be printed on the plain paper.

In addition, the fixing device 105 may perform a first fixing operation and a second fixing operation. In the first fixing operation, the fixing device 105 may fix the first toner image onto the iron-on transfer printing sheet traveling at a first speed. In the second fixing operation, the fixing device 105 may fix the second toner image onto the plain paper traveling at a second speed. In one example, the print controller 700 may control the fixing device 105 to make the first speed lower than the second speed.

[C. Iron-on Transfer Printing Method]

Next, an iron-on transfer printing method in which an iron-on transfer printing sheet on which printing is performed by the image forming apparatus 1 is used will be described with reference to FIG. 3A to FIG. 3E.

This iron-on transfer printing method may be of a so-called double-transfer scheme.

Figure 3A:
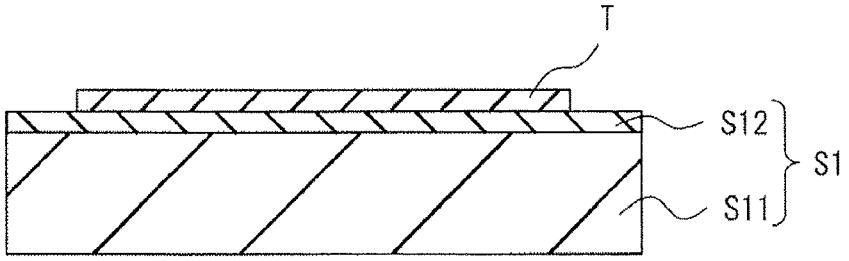
FIG. 3A is a diagram illustrating a process of an iron-on transfer printing method in which an iron-on transfer printing sheet on which printing is performed by the image forming apparatus illustrated in FIG. 1A is used.

First, with the use of the image forming apparatus 1, a toner image T may be formed on an adhesive layer S12 of an iron-on transfer printing sheet S1, as illustrated in FIG. 3A, through the procedures described above. The iron-on transfer printing sheet S1 may be an example of the print medium PM and may be obtained by providing the adhesive layer S12 on paper S11, for example.

Figure 3B:
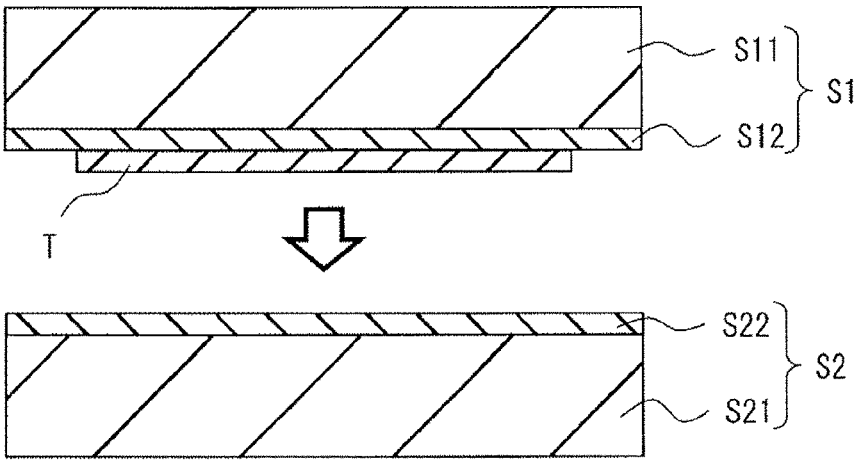
FIG. 3B is a diagram illustrating a process that follows the process illustrated in FIG. 3A.
Figure 3C:
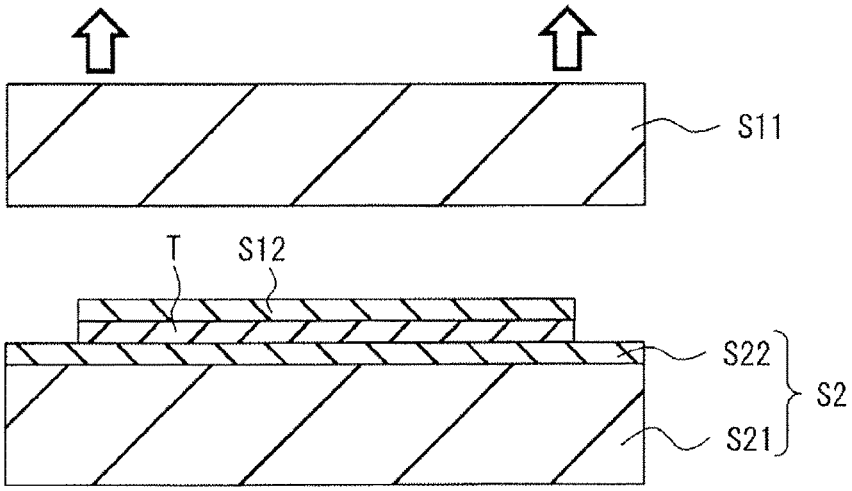
FIG. 3C is a diagram illustrating a process that follows the process illustrated in FIG. 3B.

Thereafter, as illustrated in FIG. 3B, an intermediate transfer sheet S2 may be prepared. The intermediate transfer sheet S2 may be obtained by providing a release layer S22 including an oil-and-fat material such as wax onto paper S21, for example. The intermediate transfer sheet 52 and the iron-on transfer printing sheet S1 may be overlaid on each other with the release layer S22 of the intermediate transfer sheet S2 and the toner image T on the iron-on transfer printing sheet S1 facing each other. In this state, a predetermined pressure may be applied for a predetermined time at a predetermined temperature with the use of an iron, for example. This operation may allow the toner image T to undergo a primary transfer onto the adhesive layer S12, as illustrated in FIG. 3C. As a result of the primary transfer, the adhesive layer S12 of the iron-on transfer printing sheet S1 may also be transferred onto the toner image T. In one example, in the primary transfer, heat may be applied for a duration longer than the time it takes for the print medium PM to pass through the fixing device 105 and at a temperature higher than the heating temperature of the fixing device 105, for example.

Figure 3D:
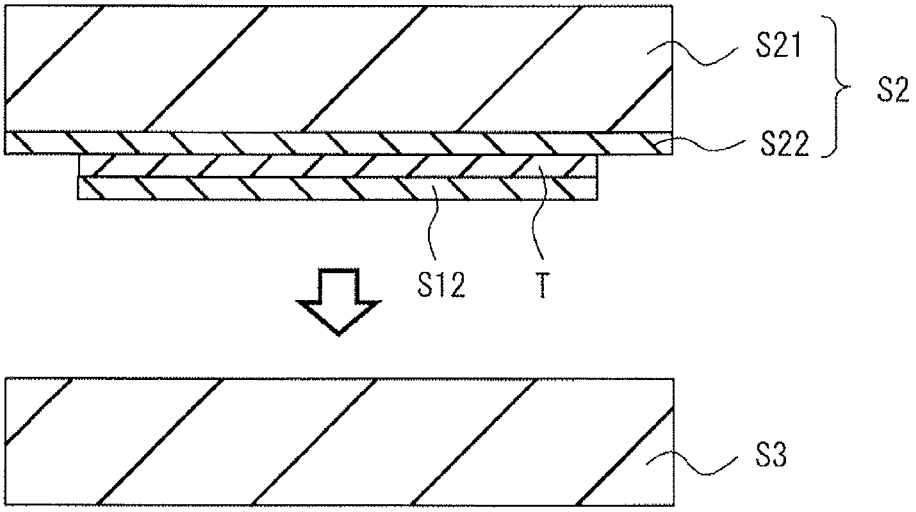
FIG. 3D is a diagram illustrating a process that follows the process illustrated in FIG. 3C.
Figure 3E:
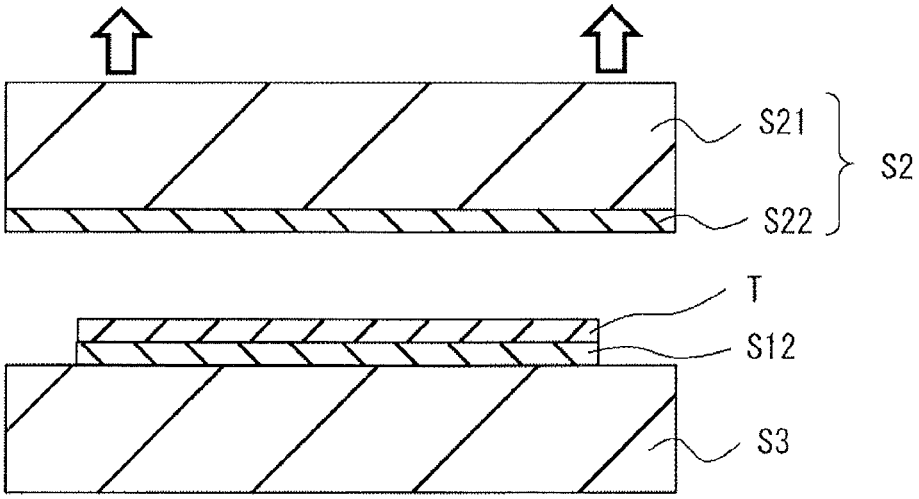
FIG. 3E is a diagram illustrating a process that follows the process illustrated in FIG. 3D.

Lastly, as illustrated in FIG. 3D, a clothing fabric S3 serving as a target onto which the toner image T is to be fixed in the end may be prepared, and the intermediate transfer sheet S2 may be overlaid on the clothing fabric S3 with the adhesive layer S12 that covers the toner image T on the release layer S22 facing the clothing fabric S3. In this state, a predetermined welding pressure may be applied for a predetermined time at a predetermined temperature with the use of an iron, for example. This operation may allow the adhesive layer S12 to melt and thus allow the toner image T to undergo a secondary transfer onto the clothing fabric S3, as illustrated in FIG. 3E. The toner image T that has undergone the secondary transfer onto the clothing fabric S3 may hardly remain on the release layer S22 of the intermediate transfer sheet S2 and may be peeled off from the release layer S22 favorably.

[D. Effects]

Typically, in a case where a toner image is formed on the clothing fabric S3 through an iron-on transfer printing method of a double-transfer scheme, a phenomenon in which a dot-like defect appears in a portion of the toner image may be observed. This dot-like defect may be referred to as a white-dot defect, hereinafter. This defect may conceivably occur due to an excessive bonding strength between the toner image T and the release layer S22 in the process of the primary transfer illustrated in FIG. 3B and FIG. 3C, for example. In other words, the white-dot defect may conceivably occur in a case where the bonding strength between the toner image T and the release layer S22 is higher than the bonding strength between the toner image T and the clothing fabric S3 with the adhesive layer S12 interposed therebetween when the toner image T undergoes the secondary transfer onto the clothing fabric S3 from the intermediate transfer sheet S2. Therefore, in one example, the bonding strength between the toner image T and the release layer S22 may be kept to a certain level.

Accordingly, in the image forming apparatus 1 according to the present example embodiment, the image forming section 103 may selectively form a first toner image and a second toner image. The first toner image may be formed with the use of the cyan toner and to be printed onto an iron-on transfer printing sheet, serving as a first print medium. The second toner image may be formed with the use of the cyan toner and to be printed on plain paper, serving as a second print medium. In addition, the print controller 700 may control the image forming section 103 to make the first area density of the cyan toner in the first toner image and the second area density of the cyan toner in the second toner image differ from each other. In one example, the print controller 700 may control the image forming section 103 to make the first area density of the cyan toner in the first toner image to be formed on the iron-on transfer printing sheet lower than the second area density of the cyan toner in the second toner image to be formed on the plain paper.

This configuration makes it possible to achieve a secondary transfer favorably when the toner image T on the iron-on transfer printing sheet S1 undergoes a primary transfer onto another print medium, e.g., the intermediate transfer sheet S2, and thereafter undergoes a secondary transfer onto yet another print medium, e.g., the clothing fabric S3. One of the reasons for this is that the bond between the release layer S22 on the intermediate transfer sheet S2 and the toner image T may be reduced to an appropriate level, which thus makes it possible to reduce the toner image T that remains on the release layer S22 during the secondary transfer. In one example, the first area density of the cyan toner in the first toner image, e.g., a first toner image T1 for convenience, to be formed on the iron-on transfer printing sheet S1 may be set equal to or greater than about 0.32 $mg/cm^2$ and equal to or less than about 0.45 $mg/cm^2$. One of the reasons for this is that the above configuration makes it possible to stably attach the first toner image T1 onto the release layer S22 during a primary transfer and stably peel off the first toner image T1 from the release layer S22 during a secondary transfer. In addition, setting the second area density in the second toner image, e.g., a second toner image T2 for convenience, to be formed on the plain paper equal to or greater than about 0.45 $mg/cm^2$ and equal to or less than about 0.5 $mg/cm^2$ makes it possible to stably attach the second toner image T2 onto the plain paper.

For the reasons described above, the image forming apparatus 1 and the image forming method according to the present example embodiment are suitable for achieving a higher-quality transfer printing image.

2. Experiment Examples

Experiment Examples 1-1 to 1-10

The iron-on transfer printing was performed on the clothing fabric S3 in accordance with the procedures described above with the use of the iron-on transfer printing sheet S on which printing is performed by the image forming apparatus 1 described in the foregoing example embodiments, and the white-dot defect in a secondary transfer image on the clothing fabric S3 was evaluated.

In these experiment examples, in each of Experiment examples 1-1 to 1-10, a toner image was formed on the iron-on transfer printing sheet S1 with the use of the toners of the four colors: the cyan toner, the yellow toner, the magenta toner, and the white toner. In each of the experiment examples, the area density of the toner in the toner image formed on the iron-on transfer printing sheet S1 was made substantially equal to the area density of the toner in the toner image formed on the plain paper. Specifically, the area density was about 0.45 mg/cm$^2$. In these experiment examples, the area density of the toner was obtained in the following manner. First, a solid pattern was printed on a print medium, i.e., on plain paper or the iron-on transfer printing sheet S1, in the image forming section 103, and the operation of the image forming apparatus 1 was stopped before the print medium reached the fixing device 105. Thereafter, the print medium on which the toner that had not undergone a fixing process was attached was taken out gently from the conveyance route of the image forming apparatus 1. Thereafter, a jig having a known weight and having a surface with a surface area of 1 cm$^2$ was prepared, and the toner attached on the print medium that had been taken out was relocated onto the surface of the jig. Lastly, the weight of the jig on the surface of which the toner was attached was measured, and thus the weight of the toner per 1 cm$^2$, i.e., the area density of the toner, was calculated on the basis of the weight difference. In these experiment examples, a solid pattern is a pattern having a ratio (B/A) of 100%, in which B is the number of dots actually formed as an image on a print medium and A is the total number of dots that are able to be formed as an image on the print medium in a predetermined area. The predetermined area may be an area corresponding to 100 sheets of the print medium or a surface area of a photosensitive drum corresponding to 100 rotations of the photosensitive drum, for example. The total number A of dots that are able to be formed as an image on the print medium in the predetermined area may be the sum of the number B of the dots actually formed as an image on the print medium and the number C of dots that are not actually formed as an image on the print medium. The total number A of the dots may also be regarded as the maximum number of potential dots that are able to be formed as an image in the predetermined area. In these experiment examples, the glass transition point Tg of the used toner base particle was 60.8° C. from the measurement carried out with a differential scanning calorimeter EXSTAR 600, available from Seiko Instruments Inc., Chiba, Japan. According to the differential scanning calorimeter, in the toner base particle, a weak heat-absorbing peak was observed between 0° C. and 70° C. during a first instance of melting, but no such weak heat-absorbing peak was observed between 0° C. and 70° C. during a second instance of melting after cooling. In addition, 4 parts by weight of hydrophobic silica R972, having a mean particle size of 16 nm, available from NIPPON AEROSIL Co., Ltd., Tokyo, Japan, serving as an external additive was added with respect to 100 parts by weight of the binder resin. Furthermore, dark garment transfer paper WoW 7.8M sheet, available from TheMagic Touch (GB) Ltd., Dieburg, Germany, was used as the iron-on transfer printing sheet S1; dark garment transfer paper WoW 7.8T, available from TheMagic Touch (GB) Ltd., Dieburg, Germany, was used as the intermediate transfer sheet S2; and a 100% cotton T-shirt was used as the clothing fabric S3. In addition, a heat press Model HTP234PS 1, available from Piotec, Co., Ltd., Hyogo, Japan, was used as an iron. When the toner image T was made to undergo a primary transfer from the iron-on transfer printing sheet S onto the intermediate transfer sheet S2, the temperature of the iron was set to 145° C., and the iron-on transfer printing sheet S1 was pressed against the intermediate transfer sheet S2 for 45 seconds. Furthermore, when the toner image T was made to undergo a secondary transfer from the intermediate transfer sheet S2 onto the clothing fabric S3, the temperature of the iron was set to 135° C., and the intermediate transfer sheet S2 was pressed against the clothing fabric S3 for 10 seconds.

Experiment Examples 1-1 to 1-3

Experiment examples 1-1 to 1-3 were carried out under the environment where the temperature was 24° C. and the humidity was 50%, which was a hygrothermal condition close to that of an office environment. Experiment example 1-1 was from initial printing, Experiment example 1-2 was from 4,000-th printing, and Experiment example 1-3 was from 8,000-th printing.

Experiment Examples 1-4 to 1-6

Experiment examples 1-4 to 1-6 were carried out under the environment where the temperature was 28° C. and the humidity was 80%, which was a hygrothermal condition close to that in the summer time. Experiment example 1-4 was from initial printing, Experiment example 1-5 was from 4,000-th printing, and Experiment example 1-6 was from 8,000-th printing.

Experiment Examples 1-7 to 1-9

Experiment examples 1-7 to 1-9 were carried out under the environment where the temperature was 10° C. and the humidity was 20%, which was a hygrothermal condition close to that in the winter time. Experiment example 1-7 was from initial printing, Experiment example 1-8 was from 4,000-th printing, and Experiment example 1-9 was from 8,000-th printing.

Experiment Example 1-10

Experiment example 1-10 was carried out under the environment where the temperature was 24° C. and the humidity was 10%, which was a dry environment. Experiment example 1-10 was from initial printing.

The evaluation of the white-dot defect in the secondary transfer image on the clothing fabric S3 was made through sensory evaluation on 10 scales in which the number of the white dots per unit area and the size of the white dots served as evaluation items. The rating of level 8 or higher corresponded to a level where no white-dot defect was observed or only minor white-dot defect was observed, which posed no problem as a product. The rating of level 7 or lower was regarded as being unacceptable. The evaluation results of Experiment example 1-1 to Experiment example 1-10 are summarized in Table 1.

TABLE 1

| | Environ-mental conditions | Number of printed sheet(s) | White defect level | | | |
|---|---|---|---|---|---|---|
| | | | Cyan toner | Yellow toner | Ma-genta toner | White toner |
| Experiment example 1-1 | 24° C., 50% | Initial printing | 7 | 10 | 9 | 9 |
| Experiment example 1-2 | 24° C., 50% | 4,000-th printing | 8 | 10 | 9 | 9 |
| Experiment example 1-3 | 24° C., 50% | 8,000-th printing | 7 | 10 | 9 | 9 |
| Experiment example 1-4 | 28° C., 80% | Initial printing | 7 | 10 | 9 | 9 |
| Experiment example 1-5 | 28° C., 80% | 4,000-th printing | 8 | 10 | 9 | 9 |
| Experiment example 1-6 | 28° C., 80% | 8,000-th printing | 8 | 10 | 9 | 9 |
| Experiment example 1-7 | 10° C., 20% | Initial printing | 7 | 10 | 9 | 9 |
| Experiment example 1-8 | 10° C., 20% | 4,000-th printing | 8 | 10 | 9 | 9 |
| Experiment example 1-9 | 10° C., 20% | 8,000-th printing | 7 | 10 | 9 | 9 |
| Experiment example 1-10 | 24° C., 10% | Initial printing | 7 | 10 | 8 | 9 |

As summarized in Table 1, in all of Experiment example 1-1 to Experiment example 1-10, an occurrence of the white-dot defect in the toner image in which the cyan toner was used is prominent.

Experiment Examples 2-1 to 2-23

Figure 4:
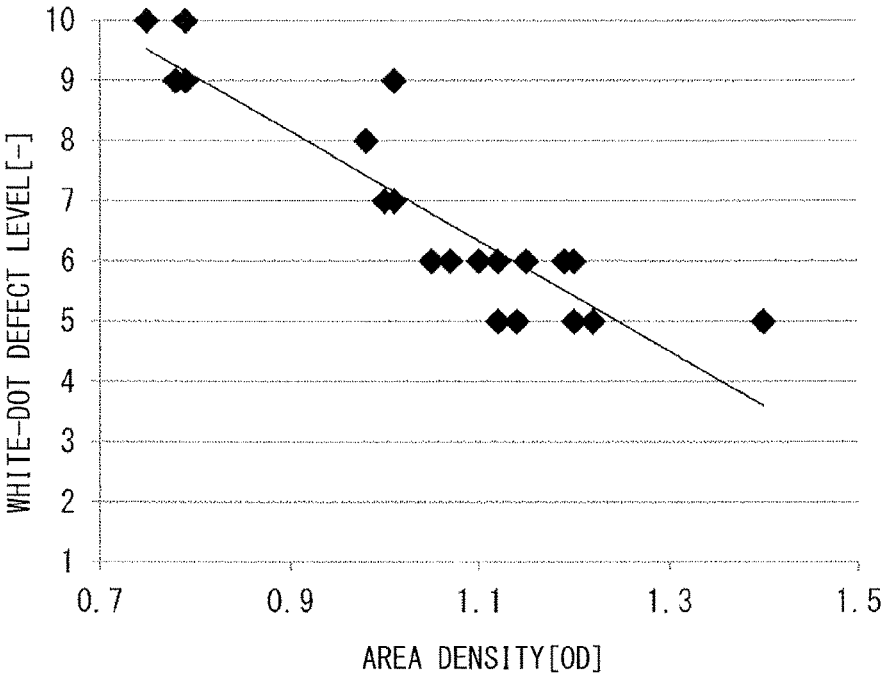
FIG. 4 is a characteristic diagram illustrating an example of a relationship between an area density of a toner image and an evaluation of a white-dot defect according to experiment examples.

Thus, with regard to the secondary transfer image of the toner image in which the cyan toner was used, the connection between the printing area density and the evaluation of the white-dot defect was investigated. The results are summarized in Table 2 and FIG. 4. The conditions other than the printing area density were similar to those in Experiment example 1-1 described above. In FIG. 4, the horizontal axis represents the printing area density of the secondary transfer image, and the vertical Axis represents the level of the white-dot defect on 10 scales. In measuring the printing area density, a portion printed at a duty of 100% onto an iron-on transfer printing sheet s1 was measured with the use of a measuring instrument X-Rite 528 Status I, available from X-Rite, Inc., Tokyo, Japan.

TABLE 2

| | Printing area density [OD] | White defect level |
|---|---|---|
| Experiment example 2-1 | 0.75 | 10 |
| Experiment example 2-2 | 0.78 | 9 |
| Experiment example 2-3 | 0.79 | 10 |
| Experiment example 2-4 | 0.79 | 9 |
| Experiment example 2-5 | 0.98 | 8 |
| Experiment example 2-6 | 1.00 | 7 |
| Experiment example 2-7 | 1.00 | 7 |
| Experiment example 2-8 | 1.00 | 7 |
| Experiment example 2-9 | 1.01 | 7 |
| Experiment example 2-10 | 1.01 | 9 |
| Experiment example 2-11 | 1.05 | 6 |
| Experiment example 2-12 | 1.07 | 6 |
| Experiment example 2-13 | 1.10 | 6 |
| Experiment example 2-14 | 1.10 | 6 |

TABLE 2-continued

| | Printing area density [OD] | White defect level |
|---|---|---|
| Experiment example 2-15 | 1.12 | 6 |
| Experiment example 2-16 | 1.12 | 5 |
| Experiment example 2-17 | 1.14 | 5 |
| Experiment example 2-18 | 1.15 | 6 |
| Experiment example 2-19 | 1.19 | 6 |
| Experiment example 2-20 | 1.20 | 6 |
| Experiment example 2-21 | 1.20 | 5 |
| Experiment example 2-22 | 1.22 | 5 |
| Experiment example 2-23 | 1.40 | 5 |

The results summarized in Table 2 and FIG. 4 reveal that the higher the printing area density is, the more the white-dot defect occurs. This phenomenon may conceivably occur because, as the printing area density is higher, the bonding strength between the toner image T and the release layer S22 becomes too high in the process of the primary transfer illustrated in FIG. 3B and FIG. 3C. In other words, this phenomenon may conceivably occur because, as the area density of the toner, i.e., the thickness of the toner, on the iron-on transfer printing sheet S1 is higher, the bonding strength between the toner image T and the release layer S22 becomes too high in the process of the primary transfer illustrated in FIG. 3B and FIG. 3C.

Experiment Examples 3-1 and 3-2

Thus, the absolute value of the developing voltage applied to the developing roller 36C was varied when a cyan toner image for an iron-on transfer printing sheet was formed, and how the white-dot defect varied as the printing area density was adjusted was investigated. Specifically, the printing area density and the white-dot defect were each compared between in a case where the absolute value of the developing voltage applied to the developing roller 36C was set to 200 V, i.e., in Experiment example 3-1, and in a case where the absolute value of the developing voltage applied to the developing roller 36C was set to 170 V, i.e., in Experiment example 3-2. It is to be noted that 200 V is the same value as the absolute value of the developing voltage applied to the developing roller 36C when a cyan toner image for plain paper is formed. The conditions other than the above were similar to those in Experiment example 1-1 described above. The results are summarized in Table 3.

TABLE 3

| | Developing voltage [−V] | Printing area density [OD] | White defect level |
|---|---|---|---|
| Experiment example 3-1 | 200 | 1.00 | 9 |
| Experiment example 3-2 | 170 | 0.95 | 7 |

As summarized in Table 3, as compared with Experiment example 3-1, in Experiment example 3-2, the absolute value of the developing voltage applied to the developing roller 36C was set smaller, which thus led to a lower printing area density and an improvement in the white-dot defect evaluation level. Therefore, it was possible to confirm that an example embodiment of the technology was suitable for achieving a higher-quality transfer printing image.

Experiment Examples 4-1 to 4-3

Furthermore, the white-dot defect was evaluated under the following conditions.

Figure 5:
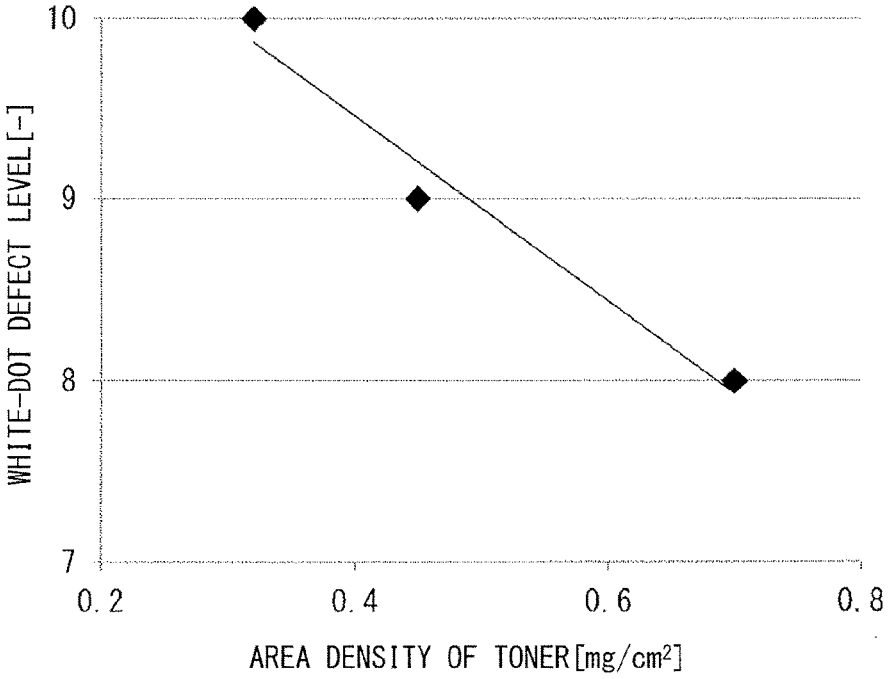
FIG. 5 is a characteristics diagram illustrating an example of a relationship between an area density of a toner and an evaluation of a white-dot defect according to the experiment examples.

The area density of the toner in a toner image formed on an iron-on transfer printing sheet was set to 0.32 mg/cm$^2$, 0.45 mg/cm$^2$, or 0.70 mg/cm$^2$, and the other conditions were similar to those in Experiment example 1-1 described above. The results are illustrated in FIG. 5. In FIG. 5, the horizontal axis represents the area density of the toner, and the vertical axis represents the level of white-dot defect on 10 numerical value scales.

The results illustrated in FIG. 5 reveal that, as the area density of the toner in the toner image formed on the iron-on transfer printing sheet is lower, it is possible to suppress an occurrence of the white-dot defect. Specifically, it was possible to confirm that the rating of level 8 or higher was ensured if the area density was equal to or greater than 0.32 mg/cm$^2$ and equal to or less than 0.70 mg/cm$^2$. In particular, it was possible to confirm that the rating of level 9 or higher was ensured if the area density was equal to or greater than 0.32 mg/cm$^2$ and equal to or less than 0.45 mg/cm$^2$.

3. Modification Examples

The technology has been described above referring to the example embodiments, but the technology is not limited to the example embodiments described above, and various modifications are possible. For example, an image forming apparatus that forms a color image with the use of only the color toners has been described in the foregoing example embodiments, but the technology is not limited thereto, and an image forming apparatus that, for example, transfers a black toner image and forms a monochrome image may also be employed. The black toner may contain carbon black, for example, and similarly to the case of the cyan toner, the area density of the toner when a toner image is to be formed on an iron-on transfer printing sheet may be set lower than the area density of the toner when a toner image is to be formed on plain paper. This configuration may be suitable for achieving a higher-quality transfer printing image. In addition, the four color toners, i.e., the cyan toner, the magenta toner, the yellow toner, and the white toner, have been illustrated as examples in the above description, but the toners in the technology are not limited thereto, and it is possible to apply the technology to a toner of another color.

A case where the type of the print medium PM is determined on the basis of the information input by an operator through the operation section 704 has been described as an example in the foregoing example embodiments, but the technology is not limited thereto. For example, information regarding the type of the print medium PM may be included in advance in a print command input from the higher device 705.

An image forming apparatus of a secondary transfer scheme has been described in the foregoing example embodiments, but the technology may also be applied to an image forming apparatus of a primary transfer scheme, i.e., of a direct transfer scheme.

Although an LED head having a light-emitting diode as a light source is used as an exposure device in the foregoing example embodiments, an exposure device having an element such as a laser element as a light source may also be used.

Furthermore, in the foregoing example embodiments, an image forming apparatus having a printing function has been described as a specific but non-limiting example of the image forming apparatus according to the technology, but the technology is not limited thereto. In other words, it is possible to apply the technology also to an image forming apparatus that functions as a multifunction peripheral having, in addition to such a printing function, a scan function and a fax function, for example.

It is possible to achieve at least the following configurations from the above-described example embodiments of the technology.

(1)

An image forming apparatus, including:

an image forming section that selectively forms a first toner image to be printed on transfer paper other than plain paper with use of a toner and forms a second toner image to be printed on the plain paper with use of the toner, and a controller that controls the image forming section and thereby makes a first area density of the toner in the first toner image and a second area density of the toner in the second toner image differ from each other.

(2)

The image forming apparatus according to (1), in which the image forming section uses a plurality of color toners as the toner, and the controller controls the image forming section and thereby makes the first area density and the second area density differ from each other when the image forming section performs printing at a maximum area density that is allowed to be set for each of the color toners.

(3)

The image forming apparatus according to (1), in which the image forming section uses a plurality of color toners as the toner, and the controller controls the image forming section and thereby makes the first area density and the second area density differ from each other when the image forming section forms a solid pattern of each color with use of corresponding one of the color toners.

(4)

The image forming apparatus according to (1), in which the image forming section uses a plurality of color toners as the toner, and the controller controls the image forming section and thereby sets each of the first area density and the second area density for each of the color toners in accordance with a color of the relevant color toner.

(5)

The image forming apparatus according to (1), in which the image forming section uses a plurality of color toners as the toner, and the controller controls the image forming section, and thereby sets the first area density in accordance with a color of one, of the color toners, that is to be attached to an uppermost layer of the first toner image and sets the second area density in accordance with a color of one, of the color toners, that is to be attached to an uppermost layer of the second toner image.

(6)

The image forming apparatus according to (1), in which the image forming section uses both a first color toner and a second color toner as the toner, and the controller controls the image forming section and thereby makes the first area density of the first color toner and the second area density of the first color toner differ from each other, and the controller controls the image forming section and thereby makes the first area density of the second color toner and the second area density of the second color toner substantially equal to each other.

(7)

The image forming apparatus according to (6), in which the first color toner is at least one ofa cyan toner and a black toner, and the controller controls the image forming section and thereby makes the first area density of the first color toner lower than the second area density of the first color toner.

(8)

The image forming apparatus according to (6) or (7), in which the first color toner includes one of Phthalocyanine Blue and carbon black as a pigment.

(9)

The image forming apparatus according to (1), in which the transfer paper includes a substrate and an adhesive layer that covers the substrate, the image forming section forms the first toner image to be printed on the adhesive layer of the transfer paper and forms the second toner image to be printed on the plain paper, and the controller controls the image forming section and thereby makes the first area density lower than the second area density.

(10)

The image forming apparatus according to (9), in which the first area density on the transfer paper is equal to or greater than about 0.32 milligrams per square centimeter and equal to or less than about 0.45 milligrams per square centimeter, and the second area density on the plain paper is equal to or greater than about 0.45 milligrams per square centimeter and equal to or less than about 0.5 milligrams per square centimeter.

(11)

The image forming apparatus according to (9) or (10), further including:

a fixing section that performs a first fixing operation of fixing the first toner image onto the transfer paper traveling at a first speed and a second fixing operation of fixing the second toner image onto the plain paper traveling at a second speed, in which the controller controls the fixing section and thereby makes the first speed lower than the second speed.

(12)

An image forming method, including:

forming, with an image forming section, a first toner image and thereby allowing a toner to be attached to transfer paper other than plain paper at a first area density; and forming, with the image forming section, a second toner image and thereby allowing the toner to be attached to the plain paper at a second area density.

(13)

The image forming method according to (12), in which a plurality of colors of toners are used as the toner, and each of the first area density and the second area density is set for each of the toners in accordance with a corresponding color of the relevant toner.

(14)

The image forming method according to (12), in which a plurality of color toners are used as the toner, and the first area density is set in accordance with a color of one, of the color toners, that is to be attached to an uppermost layer of the first toner image, and the second area density is set in accordance with a color of one, of the color toners, that is to be attached to an uppermost layer of the second toner image.

(15)

The image forming method according to any one of (12) to (14), in which a first color toner and a second color toner are used as the toner, and the first area density of the first color toner and the second area density of the first color toner are made to differ from each other, and the first area density of the second color toner and the second area density of the second color toner are made substantially equal to each other.

(16)

The image forming method according to (15), in which at least one of a cyan toner and a black toner is used as the first color toner, and the first area density of the first color toner is made lower than the second area density of the first color toner.

(17)

The image forming method according to (15) or (16), in which the first color toner includes one of Phthalocyanine Blue and carbon black as a pigment.

(18)

The image forming method according to (12), in which the transfer paper includes a substrate and an adhesive layer that covers the substrate, the first toner image is to be formed on the adhesive layer of the transfer paper, the second toner image is to be formed on the plain paper, and the first area density is made lower than the second area density.

(19)

The image forming method according to (18), in which the first area density on the transfer paper is equal to or greater than about 0.32 milligrams per square centimeter and equal to or less than about 0.45 milligrams per square centimeter, and the second area density on the plain paper is equal to or greater than about 0.45 milligrams per square centimeter and equal to or less than about 0.5 milligrams per square centimeter.

(20)

An image forming apparatus, including:

an image forming section that forms a toner image on a print medium with use of a toner; and a controller that controls the image forming section and thereby varies an area density of the toner to be attached to the print medium in accordance with a material of the print medium.

(21)

An image forming method, including:

determining a material of a print medium; and setting an area density of a toner to be attached to the print medium in accordance with the material of the print medium and forming a toner image on the print medium with use of the toner.

(22)

The image forming apparatus according to any one of (1) to (11), in which the transfer paper is an iron-on transfer printing sheet.

(23)

The image forming method according to any one of (12) to (19), in which an iron-on transfer printing sheet is used as the transfer paper.

The image forming apparatus and the image forming method according to some embodiments of the technology are suitable for achieving a higher-quality transfer printing image.

Each of the I/F controller 701, the print controller 700, the power supply controller 708, and the exposure controller 709 illustrated in FIG. 1B is implementable by circuitry that includes at least one of a field programmable gate array (FPGA), a semiconductor integrated circuit, and an application specific integrated circuit (ASIC). The FPGA is an integrated circuit (IC) designed to be configured after manufacturing in order to perform all or a part of the functions of each of the I/F controller 701, the print controller 700, the power supply controller 708, and the exposure controller 709 illustrated in FIG. 1B. The ASIC is an IC customized to perform all or a part of the functions of each of the I/F controller 701, the print controller 700, the power supply controller 708, and the exposure controller 709 illustrated in FIG. 1B. The semiconductor integrated circuit may be, for example, at least one processor such as a central processing unit (CPU). The processor may be configurable to read instructions from at least one machine readable tangible non-transitory medium to thereby perform all or a part of functions of each of the IF controller 701, the print controller 700, the power supply controller 708, and the exposure controller 709 illustrated in FIG. 1B.

The form of such a medium may include, for example, any type of magnetic medium, any type of optical medium, or any type of semiconductor memory (i.e., semiconductor circuit). The magnetic medium may be a hard disk, for example. The optical medium may be a CD or a DVD, for example. The semiconductor memory may be a volatile memory or a non-volatile memory, for example. The volatile memory may include a DRAM or a SRAM, for example. The nonvolatile memory may include a ROM or a NVRAM, for example.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive.

What is claimed is:

1. An image forming apparatus, comprising:

an image forming section that selectively forms a first toner image to be printed on a first medium with use of a plurality of color toners and forms a second toner image to be printed on a second medium with use of the plurality of color toners, the color toners including a first color toner and a second color toner; and a controller that controls the image forming section and thereby makes a first area density of the first color toner in the first toner image and a second area density of the first color toner in the second toner image differ from each other, and thereby makes a third area density of the second color toner in the first toner image and a fourth area density of the second color toner in the second toner image substantially equal to each other.

2. The image forming apparatus according to claim 1, wherein the controller controls the image forming section and thereby makes the first area density and the second area density differ from each other when: the image forming section forms, on a basis of image data the first toner image at a maximum area density that is allowed to be set for the first color toner; and the image forming section forms, on the basis of the image data, the second toner image at the maximum area density.

3. The image forming apparatus according to claim 1, wherein the controller controls the image forming section and thereby makes the first area density and the second area density differ from each other when the image forming section forms a solid pattern of a first color with use of the first color toner.

4. The image forming apparatus according to claim 1, wherein the controller controls the image forming section, and thereby sets the first area density when the first color toner is to be attached to an uppermost layer of the first toner image and sets the second area density when the first color toner is to be attached to an uppermost layer of the second toner image.

5. The image forming apparatus according to claim 1, wherein the first color toner comprises at least one of a cyan toner or a black toner, and the controller controls the image forming section and thereby makes the first area density of the first color toner lower than the second area density of the first color toner.

6. The image forming apparatus according to claim 5, wherein the first color toner includes one of Phthalocyanine Blue or carbon black as a pigment.

7. The image forming apparatus according to claim 1, wherein the first medium includes a substrate and an adhesive layer that covers the substrate, the image forming section forms the first toner image to be printed on the adhesive layer of the first medium and forms the second toner image to be printed on the second medium, and the controller controls the image forming section and thereby makes the first area density lower than the second area density.

8. The image forming apparatus according to claim 7, wherein the first area density on the first medium is equal to or greater than 0.32 milligrams per square centimeter and equal to or less than 0.45 milligrams per square centimeter, and the second area density on the second medium is equal to or greater than 0.45 milligrams per square centimeter and equal to or less than 0.5 milligrams per square centimeter.

9. The image forming apparatus according to claim 7, further comprising:

a fixing section that performs a first fixing operation of fixing the first toner image onto the first medium traveling at a first speed and a second fixing operation of fixing the second toner image onto the second medium traveling at a second speed, wherein the controller controls the fixing section and thereby makes the first speed lower than the second speed.

10. The image forming apparatus according to claim 1, wherein the first medium comprises an iron-on transfer printing sheet.

11. The image forming apparatus according to claim 1, wherein the first medium comprises transfer paper, and the second medium comprises plain paper.

12. An image forming method, comprising:

forming, with an image forming section, a first toner image and thereby allowing a first color toner to be attached to a first medium at a first area density and a second color toner to be attached to the first medium at a third area density; and forming, with the image forming section, a second toner image and thereby allowing the first color toner to be attached to a second medium at a second area density that is different from the first area density and the second color toner to be attached to the second medium at a fourth area density that is substantially equal to the third area density.

13. The image forming method according to claim 12, wherein the first area density is set when the first color toner is to be attached to an uppermost layer of the first toner image, and the second area density is set when the first color toner is to be attached to an uppermost layer of the second toner image.

14. The image forming method according to claim 12, wherein at least one of a cyan toner or a black toner is used as the first color toner, and the first area density of the first color toner is made lower than the second area density of the first color toner.

15. The image forming method according to claim 12, wherein the first color toner includes at least one of Phthalocyanine Blue or carbon black as a pigment.

16. The image forming method according to claim 12, wherein the first medium includes a substrate and an adhesive layer that covers the substrate, the first toner image is to be formed on the adhesive layer of the first medium, the second toner image is to be formed on the second medium, and the first area density is made lower than the second area density.

17. The image forming method according to claim 16, wherein the first area density on the first medium is equal to or greater than 0.32 milligrams per square centimeter and equal to or less than 0.45 milligrams per square centimeter, and the second area density on the second medium is equal to or greater than 0.45 milligrams per square centimeter and equal to or less than 0.5 milligrams per square centimeter.

18. The image forming method according to claim 12, wherein the first medium comprises transfer paper, and the second medium comprises plain paper.

* * * * *